US010626529B2

(12) United States Patent
Brunton et al.

(10) Patent No.: US 10,626,529 B2
(45) Date of Patent: Apr. 21, 2020

(54) WOVEN FABRIC-LIKE JACQUARD FABRIC FOR MATTRESS TICKING AND METHOD FOR KNITTING THE SAME

(71) Applicant: MONARCH KNITTING MACHINERY (U.K.) LTD., Leicester (GB)

(72) Inventors: David Brunton, Leicester (GB); Kimberley Hodgson, Leicester (GB); Helen Martin, Leicester (GB)

(73) Assignee: MONARCH KNITTING MACHINERY (U.K.) LTD., Leicester (GB)

( * ) Notice: Subject to any disclaimer, the term of this patent is extended or adjusted under 35 U.S.C. 154(b) by 165 days.

(21) Appl. No.: 15/729,221

(22) Filed: Oct. 10, 2017

(65) Prior Publication Data

US 2018/0100254 A1 Apr. 12, 2018

(30) Foreign Application Priority Data

Oct. 12, 2016 (JP) ..... 2016-200667

(51) Int. Cl.
*D04B 9/42* (2006.01)
*D04B 9/06* (2006.01)
(Continued)

(52) U.S. Cl.
CPC ..... *D04B 9/42* (2013.01); *D04B 9/06* (2013.01); *D04B 9/16* (2013.01); *D04B 9/38* (2013.01)

(58) Field of Classification Search
CPC ... D04B 9/42; D04B 9/06; D04B 9/16; D04B 9/38; D04B 1/102; D04B 9/08; D04B 9/26
See application file for complete search history.

(56) References Cited

U.S. PATENT DOCUMENTS 3,986,374 A 10/1976 Fane
3,990,268 A 11/1976 Smith
(Continued)

FOREIGN PATENT DOCUMENTS

DE 202009007561 U1 8/2009
EP 1 348 788 A1 10/2003
(Continued)

OTHER PUBLICATIONS

Extended European Search Report for corresponding European Application No. 17187445.6 dated Mar. 23, 2018, 3 pages.

*Primary Examiner* — Danny Worrell
(74) *Attorney, Agent, or Firm* — Alston & Bird LLP

(57) ABSTRACT

A jacquard fabric for a mattress ticking to be used for a bedding mattress and a method for knitting this jacquard fabric are provided. The method is for producing a jacquard fabric for a mattress ticking using a double-sided needle selection circular knitting machine of a rib gating type by which an arbitrary pattern is created by means of computer-based needle selection on a cylinder side, an arbitrary pattern is also created by means of computer-based needle selection on a dial side, and an arbitrary knitting structure is made in an arbitrary part by combining the pattern obtained on the cylinder side with the pattern obtained on the dial side. As a result of employing an irregular twill pattern as a background knitting structure serving as a base, a stretchable fabric that has a soft texture, a tight knitting structure, and strength similar to that of woven fabric is obtained.

20 Claims, 12 Drawing Sheets

(51) Int. Cl.
*D04B 9/16* (2006.01)
*D04B 9/38* (2006.01)

(56) References Cited

U.S. PATENT DOCUMENTS

| | | | | |
|---|---|---|---|---|
| 4,125,001 | A | 11/1978 | Bryars | |
| RE30,638 | E | 6/1981 | Bryars | |
| 4,353,229 | A * | 10/1982 | Hutchinson | D04B 1/102 66/197 |
| 5,027,618 | A | 7/1991 | Robinson et al. | |
| 5,299,435 | A | 4/1994 | Whalley | |
| 6,622,528 | B2 | 9/2003 | Masse et al. | |
| 7,536,879 | B2 | 5/2009 | Vanwelden | |
| 8,640,503 | B2 | 2/2014 | Kunde et al. | |
| 9,732,451 | B2 | 8/2017 | Lee et al. | |
| 10,174,445 | B2 * | 1/2019 | Brunton | D04B 1/102 |
| 2008/0236204 | A1 | 10/2008 | Vanwelden | |
| 2017/0130376 | A1 * | 5/2017 | Brunton | D04B 1/102 |
| 2018/0100254 | A1 * | 4/2018 | Brunton | D04B 9/06 |

FOREIGN PATENT DOCUMENTS

| | | | |
|---|---|---|---|
| EP | 1975294 | A1 | 10/2008 |
| GB | 2 233 989 | A | 1/1991 |
| JP | 2003-286636 | A | 10/2003 |

* cited by examiner

Cylinder Side

| | | | | | | | | | | | | |
|---|---|---|---|---|---|---|---|---|---|---|---|---|
| 16 | - | - | - | - | - | - | - | - | - | - | - | - |
| 15 | - | - | X | X | - | - | X | X | - | - | X | X |
| 14 | - | - | - | - | - | - | - | - | - | - | - | - |
| 13 | X | X | - | - | X | X | - | - | X | X | - | - |
| 12 | - | - | - | - | - | - | - | - | - | - | - | - |
| 11 | - | - | X | X | - | - | X | X | - | - | X | X |
| 10 | - | - | - | - | - | - | - | - | - | - | - | - |
| 9 | X | - | - | X | X | - | - | X | X | - | - | X |
| 8 | - | - | - | - | - | - | - | - | - | - | - | - |
| 7 | X | X | - | - | X | X | - | - | X | X | - | - |
| 6 | - | - | - | - | - | - | - | - | - | - | - | - |
| 5 | - | - | X | X | - | - | X | X | - | - | X | X |
| 4 | - | - | - | - | - | - | - | - | - | - | - | - |
| 3 | X | - | - | X | X | - | - | X | X | - | - | X |
| 2 | - | - | - | - | - | - | - | - | - | - | - | - |
| Feeder No. 1 | - | X | X | - | - | X | X | - | - | X | X | - |
| | D | C | B | E | D | C | B | E | D | C | B | E |

X: Knit
-: Welt

Dial Side

| | | | | | | | | | | | | |
|---|---|---|---|---|---|---|---|---|---|---|---|---|
| 16 | - | X | - | - | - | X | - | - | - | X | - | - |
| 15 | X | X | - | - | X | X | - | - | X | X | - | - |
| 14 | - | - | X | - | - | - | X | - | - | - | X | - |
| 13 | - | - | X | X | - | - | X | X | - | - | X | X |
| 12 | X | - | - | - | X | - | - | - | X | - | - | - |
| 11 | X | - | - | X | X | - | - | X | X | - | - | X |
| 10 | - | X | - | - | - | X | - | - | - | X | - | - |
| 9 | - | X | X | - | - | X | X | - | - | X | X | - |
| 8 | - | - | - | X | - | - | - | X | - | - | - | X |
| 7 | - | - | X | X | - | - | X | X | - | - | X | X |
| 6 | X | - | - | - | X | - | - | - | X | - | - | - |
| 5 | X | X | - | - | X | X | - | - | X | X | - | - |
| 4 | - | - | X | - | - | - | X | - | - | - | X | - |
| 3 | - | X | X | - | - | X | X | - | - | X | X | - |
| 2 | - | - | - | X | - | - | - | X | - | - | - | X |
| Feeder No. 1 | X | - | - | X | X | - | - | X | X | - | - | X |
| | C | B | E | D | C | B | E | D | C | B | E | D |

X: Knit
-: Welt

REFERENCE POSITION

FIG. 3A

Cylinder Side

| Feeder No. | D | C | B | E | D | C | B | E | D | C | B | E | D | C | B | E |
|---|---|---|---|---|---|---|---|---|---|---|---|---|---|---|---|---|
| 16 | - | - | - | - | - | - | - | - | - | - | - | - | b | b | - | - |
| 15 | - | - | c | c | - | - | c | c | - | - | - | - | - | - | - | - |
| 14 | - | - | - | - | - | - | - | - | - | - | - | a | - | a | - | a |
| 13 | c | c | - | - | c | c | - | - | c | c | - | - | - | - | - | - |
| 12 | - | - | - | - | - | - | - | - | - | - | b | b | - | - | b | b |
| 11 | - | - | c | c | - | - | c | c | - | - | - | - | - | - | - | - |
| 10 | - | - | - | - | - | - | - | - | - | - | a | - | a | - | a | - |
| 9 | c | - | - | c | c | - | - | c | c | - | - | - | - | - | - | - |
| 8 | - | - | - | - | - | - | - | - | - | - | b | - | - | b | b | - |
| 7 | c | c | - | - | c | c | - | - | c | c | - | - | - | - | - | - |
| 6 | - | - | - | - | - | - | - | - | - | - | - | a | - | a | - | a |
| 5 | - | - | c | c | - | - | c | c | - | - | - | - | - | - | - | - |
| 4 | - | - | - | - | - | - | - | - | - | - | - | - | b | b | - | - |
| 3 | c | - | - | c | c | - | - | c | c | - | - | - | - | - | - | - |
| 2 | - | - | - | - | - | - | - | - | - | - | a | - | a | - | a | - |
| 1 | - | c | c | - | - | c | c | - | - | c | - | - | - | - | - | - |

BG J a, b, c: Knit
-: Welt

Dial Side

| Feeder No. | C | B | E | D | C | B | E | D | C | B | E | D | C | B | E | D |
|---|---|---|---|---|---|---|---|---|---|---|---|---|---|---|---|---|
| 16 | - | b | - | - | - | b | - | - | - | b | - | - | - | - | b | - |
| 15 | c | c | - | - | c | c | - | - | c | c | - | - | c | c | - | - |
| 14 | - | - | a | - | - | - | a | - | - | - | a | - | - | - | a | - |
| 13 | - | - | c | c | - | - | c | c | - | - | c | c | - | - | c | c |
| 12 | b | - | - | - | b | - | - | - | b | - | - | - | b | - | - | - |
| 11 | c | - | - | c | c | - | - | c | c | - | - | c | c | - | - | c |
| 10 | - | a | - | - | - | a | - | - | - | a | - | - | - | a | - | - |
| 9 | - | c | c | - | - | c | c | - | - | c | c | - | - | c | c | - |
| 8 | - | - | - | b | - | - | - | b | - | - | - | b | - | - | - | b |
| 7 | - | - | c | c | - | - | c | c | - | - | c | c | - | - | c | c |
| 6 | a | - | - | - | a | - | - | - | a | - | - | - | a | - | - | - |
| 5 | c | c | - | - | c | c | - | - | c | c | - | - | c | c | - | - |
| 4 | - | - | b | - | - | - | b | - | - | - | b | - | - | - | b | - |
| 3 | - | c | c | - | - | c | c | - | - | c | c | - | - | c | c | - |
| 2 | - | - | - | a | - | - | - | a | - | - | - | a | - | - | - | a |
| 1 | c | - | - | c | c | - | - | c | c | - | - | c | c | - | - | c |

a, b, c: Knit
-: Welt

FIG. 3B

WOVEN FABRIC-LIKE JACQUARD FABRIC FOR MATTRESS TICKING AND METHOD FOR KNITTING THE SAME

CROSS REFERENCE TO RELATED APPLICATIONS

This application claims priority to Japanese Patent Application No. 2016-200667, filed Oct. 12, 2016, the contents of which are hereby incorporated by reference in their entirety.

BACKGROUND

Field of the Invention

The present invention relates to double-sided jacquard fabrics, and relates more particularly to a jacquard fabric for a mattress ticking used for a bedding mattress, and a method for knitting this jacquard fabric.

Description of Related Art

Regarding conventional techniques for jacquard fabrics knitted with general double-sided needle selection circular knitting machines and methods for knitting such jacquard fabrics, for example, "a jacquard spacer fabric and a knitting method thereof" disclosed in JP 2003-286636A (corresponding European Application: EP1348788(A1)) is known.

This conventional technique publication describes a fabric having at least one of (a) a knit welt 1×1 long stitch jacquard pattern; (b) a knit tuck 1×1 piqué long stitch jacquard pattern; and (c) a knit welt jacquard pattern of at least two colors, appearing on the front surface of the fabric, and a method for manufacturing this fabric.

The fabric described in JP 2003-286636A is a spacer fabric, which is too thick and does not have a soft texture, and is thus not suitable for a mattress ticking fabric used for a bedding mattress. For a mattress ticking, a stretchable fabric that has a soft texture, a tight knitting structure, and strength similar to that of woven fabric is desired.

BRIEF SUMMARY

The present invention has been made to solve the foregoing problem, and aims to provide a jacquard fabric for a mattress ticking to be used for a bedding mattress, and a method for knitting this jacquard fabric.

The inventors knitted a variety of fabrics through trial and error in order to obtain a fabric suitable for a jacquard fabric for a mattress ticking, and reached the present invention.

The present invention is a method for producing a background structure in a jacquard fabric for a mattress ticking using a double-sided needle selection circular knitting machine of a rib gating type, the method by which an arbitrary pattern is created by means of computer-based needle selection on a cylinder side, an arbitrary pattern is also created by means of computer-based needle selection on a dial side, and an arbitrary knitting structure is made in an arbitrary part by combining the pattern obtained on the cylinder side with the pattern obtained on the dial side, the background structure being a knitting structure in which one repeat is constituted by four or more feeders as shown in FIG. 7, the method including:

(i) at first and third feeders, in a course direction, repeating a process of knitting knitting yarn with two consecutive cylinder needles and welting with one cylinder needle, and thereafter, on the dial side, knitting the knitting yarn with two consecutive dial needles; and (ii) at second and fourth feeders, in the course direction, repeating a process of knitting the knitting yarn with one dial needle and welting with three dial needles on the dial side opposed to the cylinder side on which the jacquard structure is expressed (claim 1).

In (i), a twill pattern can be formed by knitting at a plurality of feeders with two consecutive needles shifted from a reference position by one or more needles (claim 2).

In (ii), a twill pattern can be formed by knitting at a plurality of feeders with one needle shifted from a reference position by one or more needles (claim 3).

In another aspect, the present invention is a method for producing a background structure in a jacquard fabric for a mattress ticking using a double-sided needle selection circular knitting machine of a rib gating type, the method by which an arbitrary pattern is created by means of computer-based needle selection on a cylinder side, an arbitrary pattern is also created by means of computer-based needle selection on a dial side, and an arbitrary knitting structure is made in an arbitrary part by combining the pattern obtained on the cylinder side with the pattern obtained on the dial side, the method including:

as shown in FIGS. 1A and 1B, in a course direction from a reference position indicated by an alternate long and short dashed line in FIGS. 1A and 1B, at a first feeder, repeating a process of knitting yarn with two consecutive cylinder needles and welting with one cylinder needle, and thereafter, on the dial side, knitting the knitting yarn with two consecutive dial needles;

at a second feeder, repeating a process of welting with two consecutive dial needles, knitting the knitting yarn with one dial needle, and welting with one dial needle;

at a third feeder, repeating a process of welting with one cylinder needle, thereafter, on the dial side, knitting the knitting yarn with two consecutive dial needles, and thereafter, on the cylinder side, knitting the knitting yarn with two consecutive cylinder needles;

at a fourth feeder, repeating a process of welting with one dial needle, knitting the knitting yarn with one dial needle, and welting with two consecutive dial needles;

at a fifth feeder, repeating a process of knitting the knitting yarn with one dial needle, thereafter, on the cylinder side, knitting the knitting yarn with two consecutive cylinder needles, welting with one cylinder needle, and thereafter, on the dial side, knitting the knitting yarn with one dial needle;

at a six feeder, repeating a process of welting with three consecutive dial needles, and knitting the knitting yarn with one dial needle;

at a seventh feeder, repeating a process of knitting the knitting yarn with one cylinder needle, welting with one cylinder needle, thereafter, on the dial side, knitting the knitting yarn with two consecutive dial needles, and thereafter, on the cylinder side, knitting the knitting yarn with one cylinder needle;

at an eighth feeder, performing the same process as at the second feeder;

at a ninth feeder, performing the same process as at the third feeder;

at a tenth feeder, repeating a process of knitting with one dial needle and welting with three consecutive dial needles;

at an eleventh feeder, performing the same process as at the first feeder;

at a twelfth feeder, performing the same process as at the sixth feeder;

at a thirteenth feeder, performing the same process as at the seventh feeder;

at a fourteenth feeder, performing the same process as at the fourth feeder;

at a fifteenth feeder, performing the same process as at the fifth feeder;

at a sixteenth feeder, performing the same process as at the tenth feeder; and thereafter repeating above processes in a feeder (wale) direction (claim 4).

In this method, the cylinder needles and the dial needles can be selected in an opposite manner (claim 7).

Preferably, color-a bright polyester yarn is knitted at the second, sixth, tenth, and fourteenth feeders. Color-b bright polyester yarn is knitted at the fourth, eighth, twelfth, and sixteenth feeders. Color-c spun polyester yarn is knitted at the first, third, fifth, seventh, ninth, eleventh, thirteenth, and fifteenth feeders (claim 5).

Preferably, lay-in yarn is inserted between the first feeder and the second feeder, between the third feeder and the fourth feeder, between the fifth feeder and the sixth feeder, between the seventh feeder and the eighth feeder, between the ninth feeder and the tenth feeder, between the eleventh feeder and the twelfth feeder, between the thirteenth feeder and the fourteenth feeder, and between the fifteenth feeder and the sixteenth feeder (claim 6).

The present invention also includes a fabric produced by the above method (claim 8). In one sheet of jacquard fabric for a mattress ticking according to the present invention, a portion of the background structure and a portion of the jacquard structure are intermixed.

Effects of the Invention

According to the present invention, as a result of employing an irregular twill pattern as a background knitting structure serving as a base, a stretchable fabric that has a soft texture, a tight knitting structure, and strength similar to that of woven fabric is obtained. Furthermore, by using bright polyester yarn and spun polyester yarn on the front surface of the fabric, a jacquard structure that is a glossy portion and a background structure that is a non-glossy portion are obtained, and a fabric that is most suitable for a mattress ticking with a good design is obtained.

BRIEF DESCRIPTION OF THE FIGURES

FIG. 3A shows expanded pattern diagrams showing the background structure in Embodiment 1.

FIG. 3B shows expanded pattern diagrams showing the background structure (BG) and the jacquard structure (J) in Embodiment 1.

DETAILED DESCRIPTION OF VARIOUS EMBODIMENTS

Hereinafter, embodiments of the present invention will be described based on the attached drawings.

Woven Fabric-Like Jacquard Fabric for Mattress Ticking

A woven fabric-like jacquard fabric for a mattress ticking is a fabric knitted using a computer-based double knit circular knitting machine (V-LEC6DSIB/36 inches/28 gauges/60 feeders; manufactured by Precision Fukuhara Works, Ltd.). A double-sided needle selection circular knitting machine is used, and thus it is possible to create an arbitrary pattern with computer-based needle selection on a cylinder side and also create an arbitrary pattern with computer-based needle selection on a dial side, and to make an arbitrary knitting structure in an arbitrary part by combining the pattern obtained on the cylinder side with the pattern obtained on the dial side.

In the exploded fabric diagrams in FIGS. 1A, 1B, 2A, 2B, 3A, and 3B, the arrangement type of the cylinder needles and the dial needles is rib gating. For convenience of description, regarding the cylinder needles, a needle B, a needle C, a needle D, and a needle E are arranged in this order from right to left, and similarly regarding the dial needles, a needle B, a needle C, a needle D, and a needle E are arranged in this order from right to left. These needles are set such that each cylinder needle B is rib gated with respect to the corresponding dial needles E and B.

Embodiment 1

In Embodiment 1, a fabric having a three-color jacquard pattern is knitted in the following order. At second, sixth, tenth, and fourteenth feeders, color-a, 167 dtex bright polyester yarn is knitted. At fourth, eighth, twelfth, and sixteenth feeders, color-b, 167 dtex bright polyester yarn is knitted. At first, third, fifth, seventh, ninth, eleventh, thirteenth, and fifteenth feeders, color-c spun polyester yarn with a yarn count of 30 is knitted. Using these three colors, a jacquard pattern constituted by a color-c background structure and a color-a and color-b jacquard structure is caused to appear on a front surface of the fabric (on the cylinder side). Lay-in yarn, which is 122-dtex textured polyester yarn, is inserted as a filling material in a bag-like knitting part.

Figure 1A:
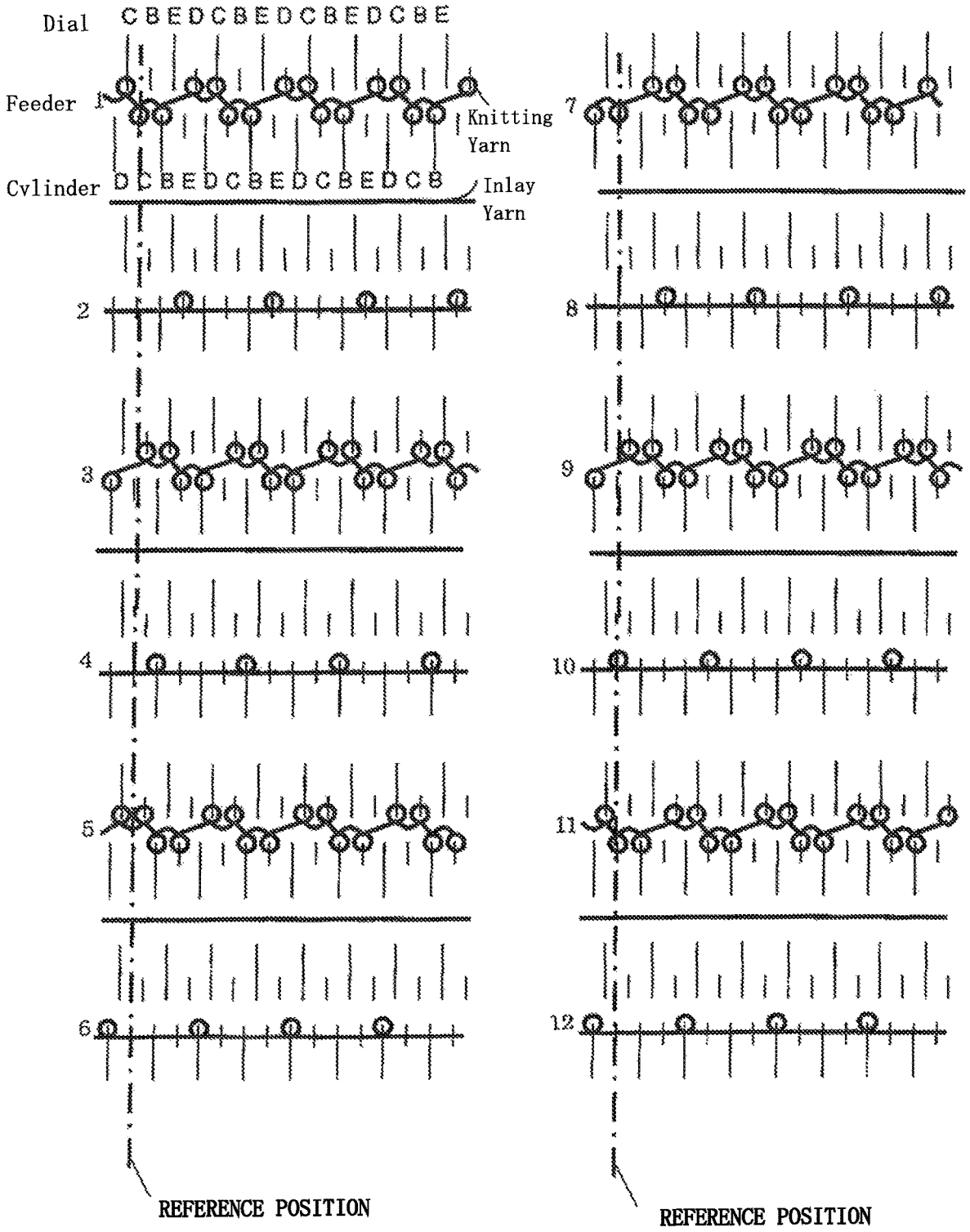
FIG. 1A is an exploded fabric diagram showing a background structure in Embodiment 1.
Figure 1B:
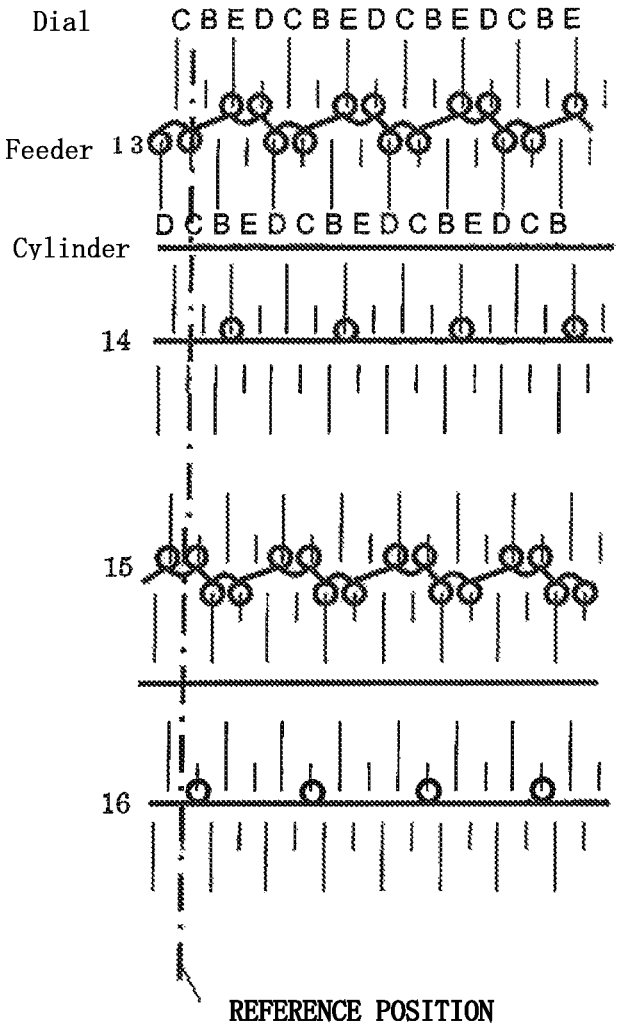
FIG. 1B is an exploded fabric diagram showing the background structure in Embodiment 1 (continued from FIG. 1A).

FIGS. 1A and 1B show exploded fabric diagrams showing a background structure in Embodiment 1.

Figure 2A:
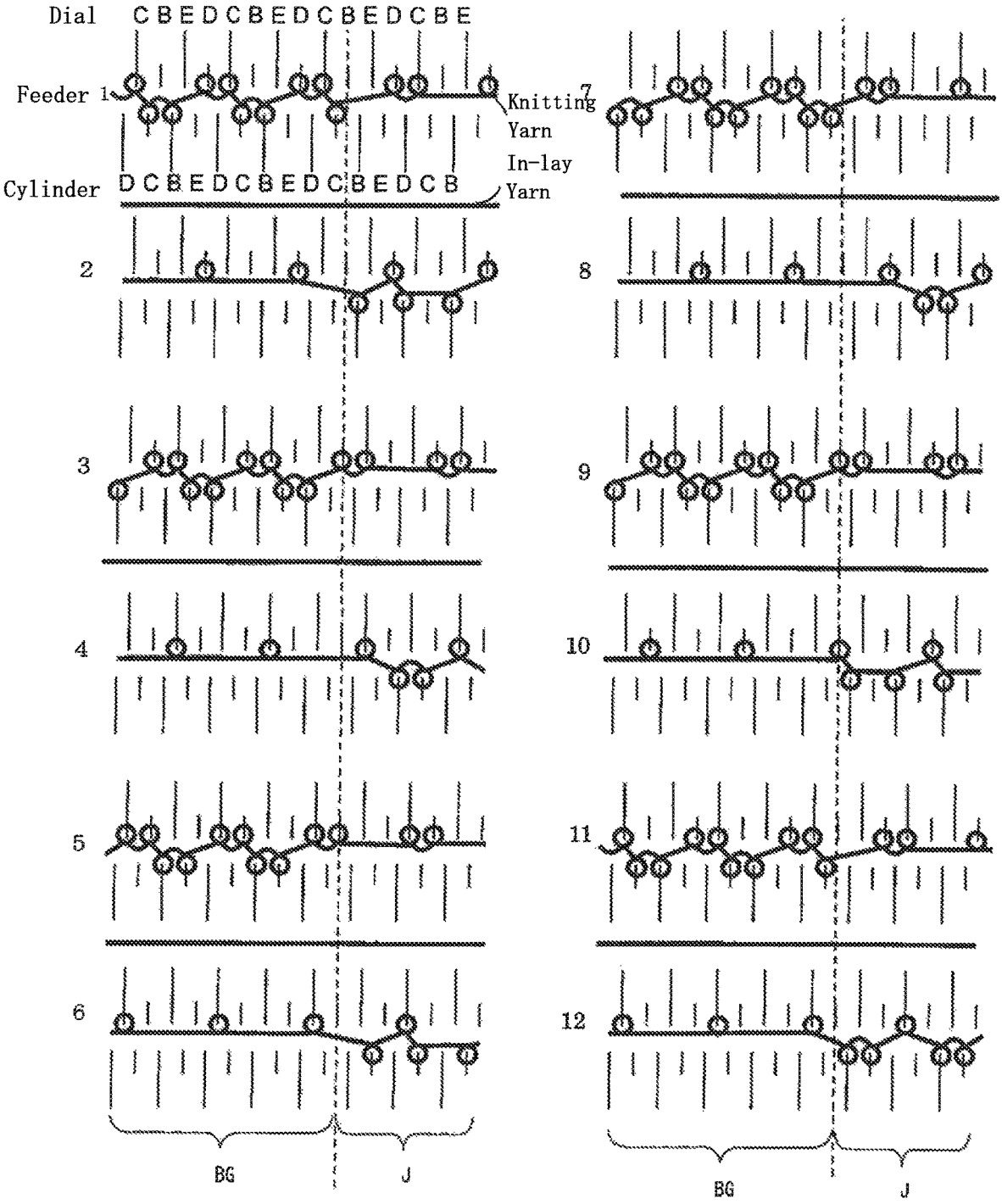
FIG. 2A is an exploded fabric diagram showing the background structure and a jacquard structure in Embodiment 1.
Figure 2B:
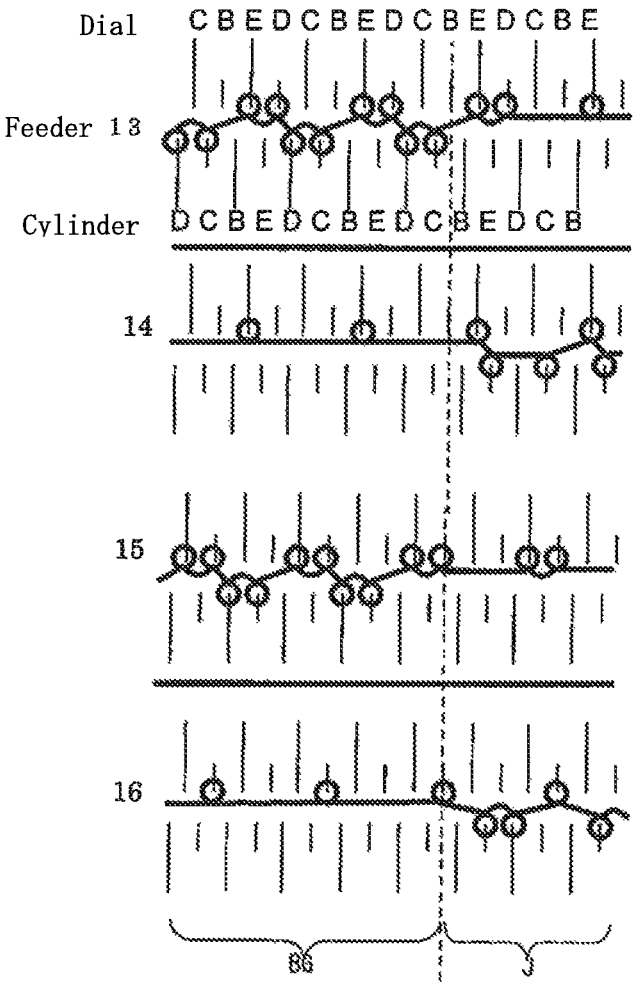
FIG. 2B is an exploded fabric diagram showing the background structure and the jacquard structure in Embodiment 1 (continued from FIG. 2A).

FIGS. 2A and 2B show exploded fabric diagrams for causing the background structure (BG) and a jacquard structure (J) in Embodiment 1 to appear.

At the first feeder, on a cylinder side, cylinder needles B and C knit, and cylinder needles D and E welt in a section for knitting the background structure. In a section for knitting the jacquard structure, all cylinder needles welt. On the other hand, on the dial side, dial needles C and D knit, and dial needles B and E welt for both the background structure and the jacquard structure.

At the second feeder, on the cylinder side, all cylinder needles welt in the section for knitting the background structure. In the section for knitting the jacquard structure, the cylinder needles B and D knit, and the cylinder needles C and E welt. On the other hand, on the dial side, the dial needles D knit, and the dial needles B, C, and E welt for both the background structure and the jacquard structure.

The lay-in yarn is inserted between verges of the cylinder and the dial, between the first feeder and the second feeder.

At the third feeder, on the cylinder side, the cylinder needles D and E knit, and the cylinder needles B and C welt in the section for knitting the background structure. In the section for knitting the jacquard structure, all cylinder needles welt. On the other hand, on the dial side, the dial needles B and E knit, and the dial needles C and D welt for both the background structure and the jacquard structure.

At the fourth feeder, on the cylinder side, all cylinder needles welt in the section for knitting the background structure. In the section for knitting the jacquard structure, cylinder needles C and D knit, and cylinder needles B and E welt. On the other hand, on the dial side, the dial needles E knit, and the dial needles B, C, and D welt for both the background structure and the jacquard structure.

The lay-in yarn is inserted between the verges of the cylinder and the dial, between the third feeder and the fourth feeder.

At the fifth feeder, on the cylinder side, the cylinder needles B and E knit, and the cylinder needles C and D welt in the section for knitting the background structure. In the section for knitting the jacquard structure, all cylinder needles welt. On the other hand, on the dial side, the dial needles B and C knit, and the dial needles D and E welt for both the background structure and the jacquard structure.

At the sixth feeder, on the cylinder side, all cylinder needles welt in the section for knitting the background structure. In the section for knitting the jacquard structure, the cylinder needles C and E knit, and the cylinder needles B and D welt. On the other hand, on the dial side, the dial needles C knit, and the dial needles B, D, and E welt for both the background structure and the jacquard structure.

The lay-in yarn is inserted between the verges of the cylinder and the dial, between the fifth feeder and the sixth feeder.

At the seventh feeder, on the cylinder side, the cylinder needles C and D knit, and the cylinder needles B and E welt in the section for knitting the background structure. In the section for knitting the jacquard structure, all cylinder needles welt. On the other hand, on the dial side, the dial needles D and E knit, and the dial needles B and C welt for both the background structure and the jacquard structure.

At the eighth feeder, on the cylinder side, all cylinder needles welt in the section for knitting the background structure. In the section for knitting the jacquard structure, the cylinder needles B and C knit, and the cylinder needles D and E welt. On the other hand, on the dial side, the dial needles D knit, and the dial needles B, C, and E welt for both the background structure and the jacquard structure.

The lay-in yarn is inserted between the verges of the cylinder and the dial, between the seventh feeder and the eighth feeder.

At the ninth feeder, on the cylinder side, the cylinder needles D and E knit, and the cylinder needles B and C welt in the section for knitting the background structure. In the section for knitting the jacquard structure, all cylinder needles welt. On the other hand, on the dial side, the dial needles B and E knit, and the dial needles C and D welt for both the background structure and the jacquard structure.

At the tenth feeder, on the cylinder side, all cylinder needles welt in the section for knitting the background structure. In the section for knitting the jacquard structure, the cylinder needles B and D knit, and the cylinder needles C and E welt. On the other hand, on the dial side, the dial needles B knit, and the dial needles C, D, and E welt for both the background structure and the jacquard structure.

The lay-in yarn is inserted between the verges of the cylinder and the dial, between the ninth feeder and the tenth feeder.

At the eleventh feeder, on the cylinder side, the cylinder needles B and C knit, and the cylinder needles D and E welt in the section for knitting the background structure. In the section for knitting the jacquard structure, all cylinder needles welt. On the other hand, on the dial side, the dial needles C and D knit, and the dial needles B and E welt for both the background structure and the jacquard structure.

At the twelfth feeder, on the cylinder side, all cylinder needles welt in the section for knitting the background structure. In the section for knitting the jacquard structure, the cylinder needles B and E knit, and the cylinder needles C and D welt. On the other hand, on the dial side, the dial needles C knit, and the dial needles B, D, and E welt for both the background structure and the jacquard structure.

The lay-in yarn is inserted between the verges of the cylinder and the dial, between the eleventh feeder and the twelfth feeder.

At the thirteenth feeder, on the cylinder side, the cylinder needles C and D knit, and the cylinder needles B and E welt in the section for knitting the background structure. In the section for knitting the jacquard structure, all cylinder needles welt. On the other hand, on the dial side, the dial needles D and E knit, and the dial needles B and C welt for both the background structure and the jacquard structure.

At the fourteenth feeder, on the cylinder side, all cylinder needles welt in the section for knitting the background structure. In the section for knitting the jacquard structure, the cylinder needles C and E knit, and the cylinder needles B and D welt. On the other hand, on the dial side, the dial needles E knit, and the dial needles B, C, and D welt for both the background structure and the jacquard structure.

The lay-in yarn is inserted between the verges of the cylinder and the dial, between the thirteenth feeder and the fourteenth feeder.

At the fifteenth feeder, on the cylinder side, the cylinder needles B and E knit, and the cylinder needles C and D welt in the section for knitting the background structure. In the section for knitting the jacquard structure, all cylinder needles welt. On the other hand, on the dial side, the dial needles B and C knit, and the dial needles D and E welt for both the background structure and the jacquard structure.

At the sixteenth feeder, on the cylinder side, all cylinder needles welt in the section for knitting the background structure. In the section for knitting the jacquard structure, the cylinder needles D and E knit, and the cylinder needles B and C welt. On the other hand, on the dial side, the dial needles B knit, and the dial needles C, D, and E welt for both the background structure and the jacquard structure.

The lay-in yarn is inserted between the verges of the cylinder and the dial, between the fifteenth feeder and the sixteenth feeder.

Thereafter, the knitting method at the first feeder to the sixteenth feeder is repeated.

Note that, in the above example, a desired jacquard pattern, which is constituted by the background structure and the jacquard structure, is caused to appear on the cylinder side. Selection of the cylinder needles for the jacquard structure is thus not limited to the above. The jacquard pattern may be caused to appear on the dial side. The pattern may be horizontally reversed.

FIG. 3A shows expanded pattern diagrams of a fabric knitted based on the background structure in Embodiment 1 as viewed from the cylinder side and the dial side. FIG. 3B shows expanded pattern diagrams of a fabric knitted based on the background structure (BG) and the jacquard structure (J) in Embodiment 1 as viewed from the cylinder side and the dial side. The positions of the jacquard structure in FIG. 3B correspond to the positions of the jacquard structure shown in FIG. 2A.

Figure 4:
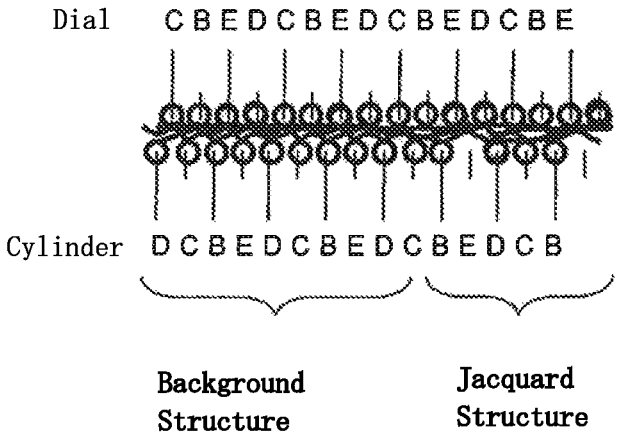
FIG. 4 is an exploded fabric diagram showing the jacquard structure in which four threads at a first feeder to a fourth feeder in Embodiment 1 are overlaid with one another.

FIG. 4 is an exploded diagram of a fabric in which a three-color jacquard structure formed by overlaying four threads at the first feeder to the fourth feeder in Embodiment 1 is caused to appear on the cylinder side.

This fabric in Embodiment 1 has strength similar to that of woven fabric due to an irregular twill pattern as shown in the expanded pattern diagrams, as well as a knitting structure having a strong texture, and is a fabric having a soft texture, which is most suitable for a jacquard fabric for a mattress ticking.

Comparative Example 1

Figure 5A:
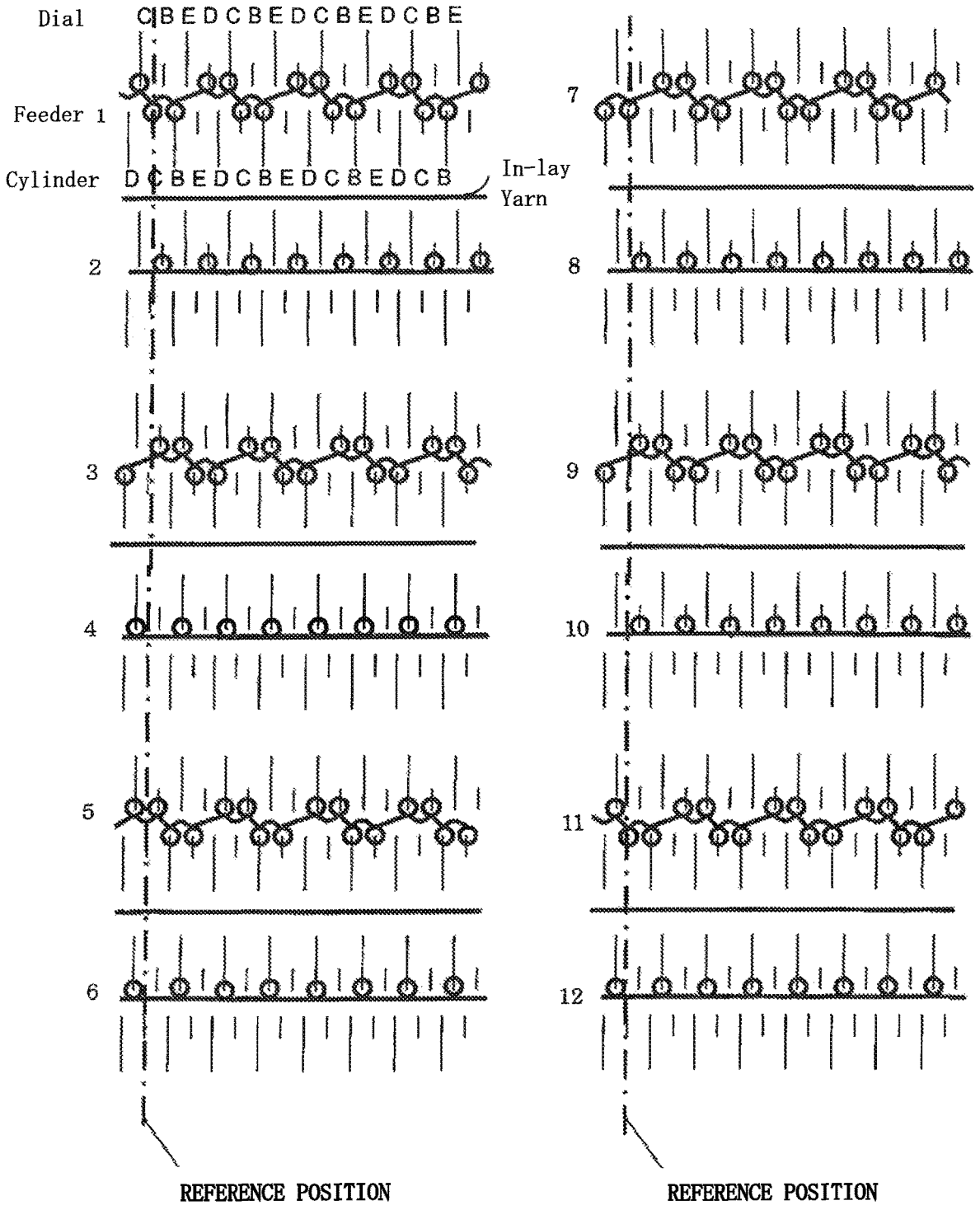
FIG. 5A is an exploded fabric diagram showing a background structure in Comparative Example 1.
Figure 5B:
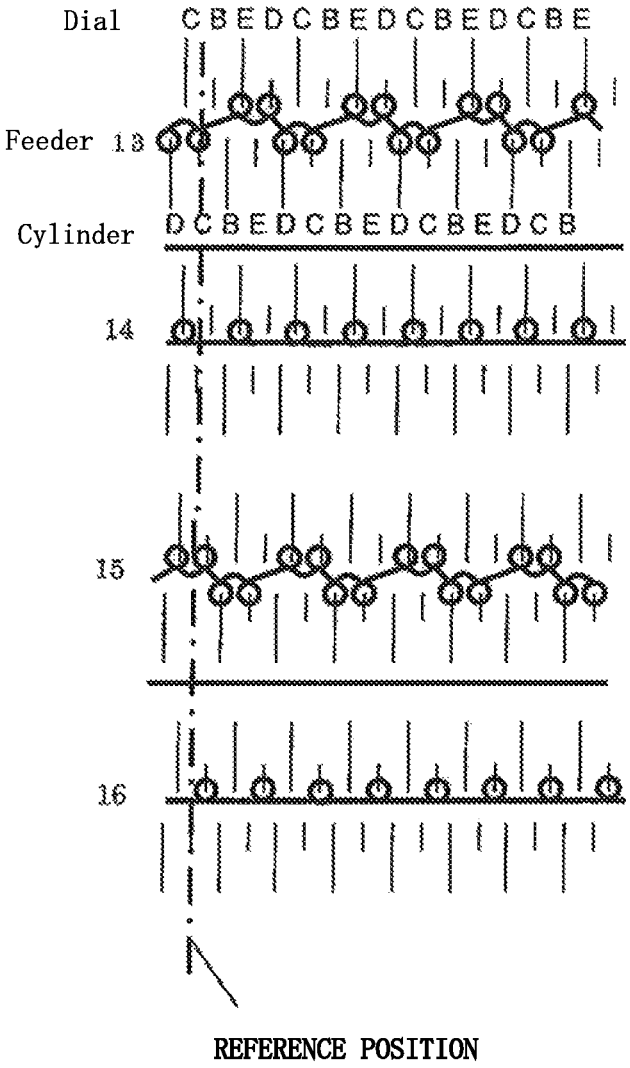
FIG. 5B is an exploded fabric diagram showing the background structure in Comparative Example 1 (continued from FIG. 5A).
Figure 6A:
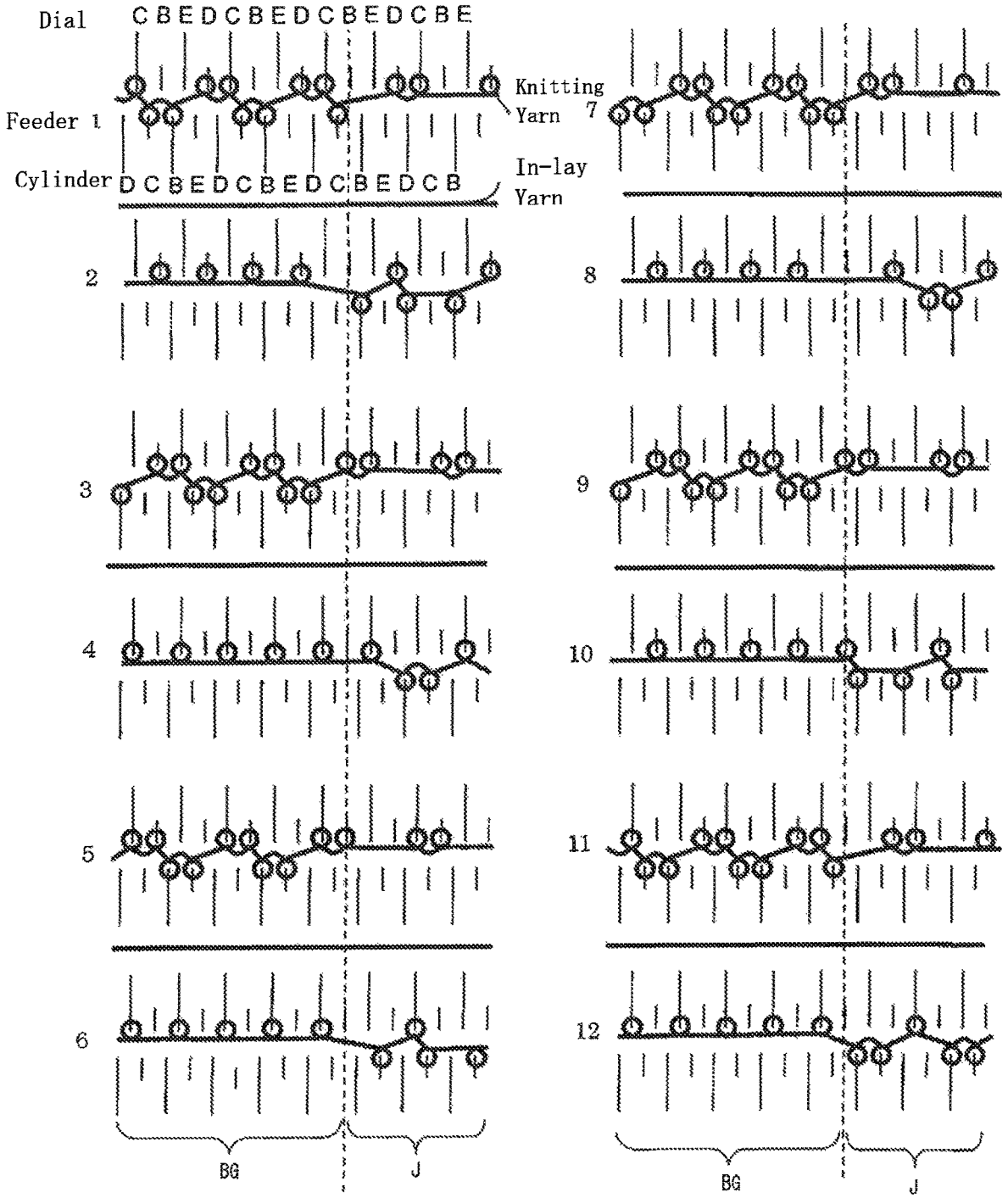
FIG. 6A is an exploded fabric diagram showing the background structure (BG) and a jacquard structure (J) in Comparative Example 1.
Figure 6B:
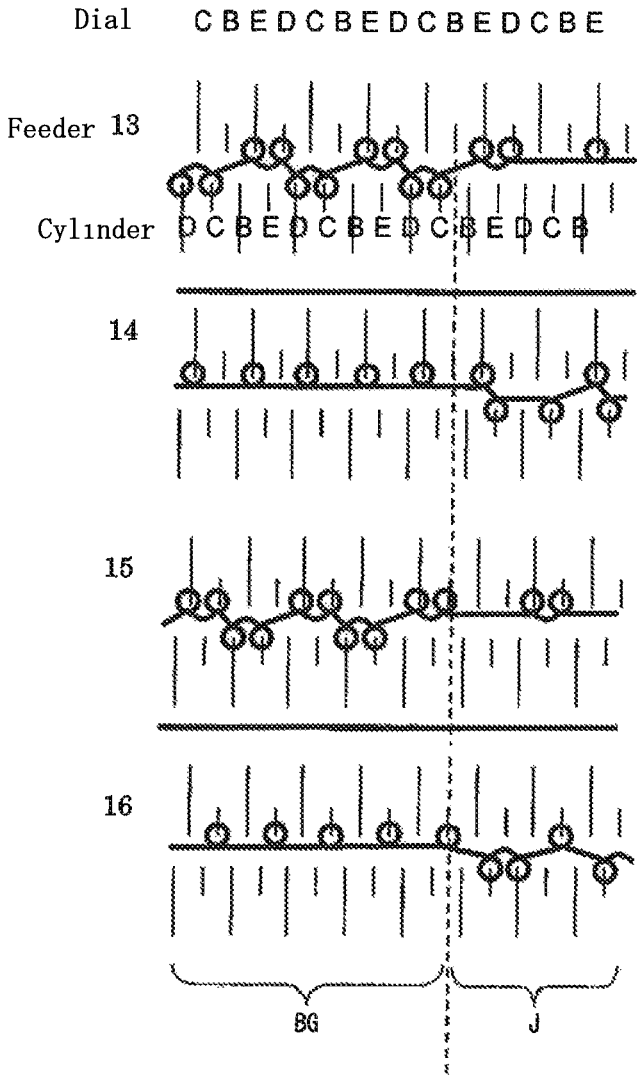
FIG. 6B is an exploded fabric diagram showing the background structure (BG) and the jacquard structure (J) in Comparative Example 1 (continued from FIG. 6A).

FIGS. 5A and 5B show exploded fabric diagrams of a background structure in Comparative Example 1. The fabric in Comparative Example 1 is obtained by repeating welting with one dial needle and knitting with one dial needle at the second, fourth, sixth, eighth, tenth, twelfth, fourteenth, and sixteenth feeders in Embodiment 1, and knitting in the same manner as in Embodiment 1 in the other part.

Next, the evaluation of the fabric in Embodiment 1 and the fabric in Comparative Example 1 is shown in the following table.

TABLE 1

| | Handle and touch |
|---|---|
| Embodiment 1 | More rigid structure<br>Good |
| Comparative Example 1 | Too heavy and rigid<br>Not good |

Embodiment 2

Figure 7:
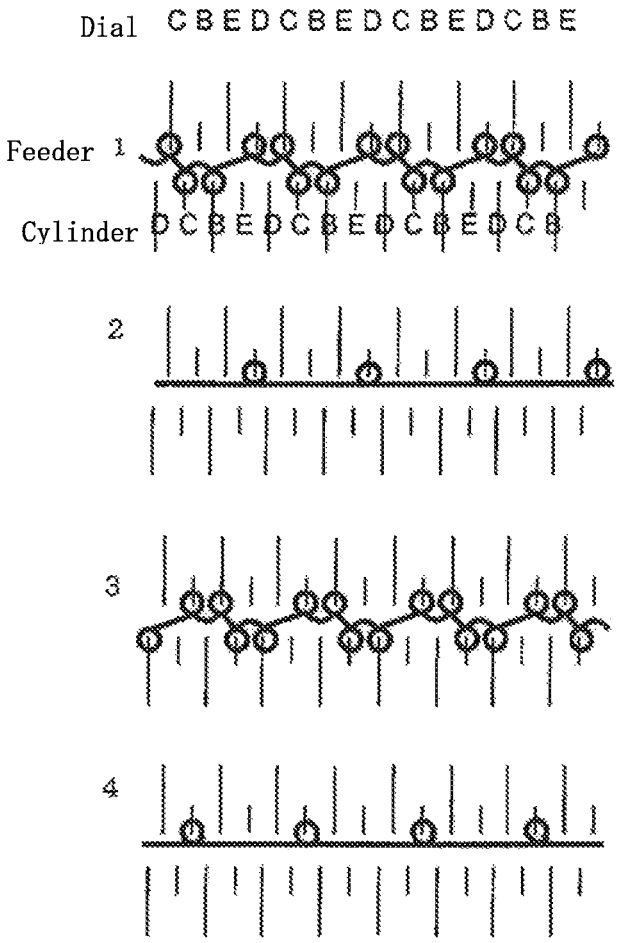
FIG. 7 is an exploded fabric diagram showing a background structure in Embodiment 2.

FIG. 7 shows Embodiment 2, which is achieved by modifying the background structure in Embodiment 1. This method is a method for manufacturing a background structure that is a knitting structure in which one repeat is constituted by four or more feeders, in a jacquard fabric for a mattress ticking. The method includes:

(i) at first and third feeders, in a course direction, repeating a process of knitting knitting yarn with two consecutive cylinder needles and welting with one cylinder needle, and thereafter, on a dial side, knitting the knitting yarn with two consecutive dial needles; and (ii) at second and fourth feeders, in the course direction, repeating a process of knitting the knitting yarn with one dial needle and welting with three dial needles on the dial side opposed to a cylinder side on which a jacquard structure is expressed.

In this Embodiment 2 as well, a stretchable fabric that has a soft texture, a tight knitting structure, and strength similar to that of woven fabric is obtained as in Embodiment 1.

The invention claimed is:

1. A method for producing a background structure in a jacquard fabric for a mattress ticking using a double-sided needle selection circular knitting machine of a rib gating type, the method by which an arbitrary pattern is created by means of computer-based needle selection on a cylinder side, an arbitrary pattern is also created by means of computer-based needle selection on a dial side, and an arbitrary knitting structure is made in an arbitrary part by combining the pattern obtained on the cylinder side with the pattern obtained on the dial side, the background structure being a knitting structure in which one repeat is constituted by four or more feeders, the method comprising:

(i) at first and third feeders, in a course direction, repeating a process of knitting knitting yarn with two consecutive cylinder needles and welting with one cylinder needle, and thereafter, on the dial side, knitting the knitting yarn with two consecutive dial needles; and (ii) at second and fourth feeders, in the course direction, repeating a process of knitting the knitting yarn with one dial needle and welting with three dial needles on the dial side opposed to the cylinder side on which the jacquard structure is expressed.

2. The method for producing a background structure in a jacquard fabric for a mattress ticking according to claim 1, wherein, in (i), a twill pattern is formed by knitting at a plurality of feeders with two consecutive needles shifted from a reference position by one or more needles.

3. The method for producing a background structure in a jacquard fabric for a mattress ticking according to claim 1, wherein, in (ii), a twill pattern is formed by knitting at a plurality of feeders with one needle shifted from a reference position by one or more needles.

4. A method for producing a background structure in a jacquard fabric for a mattress ticking using a double-sided needle selection circular knitting machine of a rib gating type, the method by which an arbitrary pattern is created by means of computer-based needle selection on a cylinder side, an arbitrary pattern is also created by means of computer-based needle selection on a dial side, and an arbitrary knitting structure is made in an arbitrary part by combining the pattern obtained on the cylinder side with the pattern obtained on the dial side, the method comprising:

in a course direction from a reference position, at a first feeder, repeating a process of knitting knitting yarn with two consecutive cylinder needles and welting with one cylinder needle, and thereafter, on the dial side, knitting the knitting yarn with two consecutive dial needles;

at a second feeder, repeating a process of welting with two consecutive dial needles, knitting the knitting yarn with one dial needle, and welting with one dial needle;

at a third feeder, repeating a process of welting with one cylinder needle, thereafter, on the dial side, knitting the knitting yarn with two consecutive dial needles, and thereafter, on the cylinder side, knitting the knitting yarn with two consecutive cylinder needles;

at a fourth feeder, repeating a process of welting with one dial needle, knitting the knitting yarn with one dial needle, and welting with two consecutive dial needles;

at a fifth feeder, repeating a process of knitting the knitting yarn with one dial needle, thereafter, on the cylinder side, knitting the knitting yarn with two consecutive cylinder needles, welting with one cylinder needle, and thereafter, on the dial side, knitting the knitting yarn with one dial needle;

at a six feeder, repeating a process of welting with three consecutive dial needles, and knitting the knitting yarn with one dial needle;

at a seventh feeder, repeating a process of knitting the knitting yarn with one cylinder needle, welting with one cylinder needle, thereafter, on the dial side, knitting the knitting yarn with two consecutive dial needles, and thereafter, on the cylinder side, knitting the knitting yarn with one cylinder needle;

at an eighth feeder, performing the same process as at the second feeder;

at a ninth feeder, performing the same process as at the third feeder;

at a tenth feeder, repeating a process of knitting with one dial needle and welting with three consecutive dial needles;

at an eleventh feeder, performing the same process as at the first feeder;

at a twelfth feeder, performing the same process as at the sixth feeder;

at a thirteenth feeder, performing the same process as at the seventh feeder;

at a fourteenth feeder, performing the same process as at the fourth feeder;

at a fifteenth feeder, performing the same process as at the fifth feeder;

at a sixteenth feeder, performing the same process as at the tenth feeder; and thereafter repeating above processes in a feeder (wale) direction.

5. The method for producing a background structure in a jacquard fabric for a mattress ticking according to claim 4, wherein a jacquard pattern constituted by a jacquard structure and a background structure is formed on the cylinder side, the jacquard structure being knitted in a color a at the second, sixth, tenth, and fourteenth feeders, and a color b at the fourth, eighth, twelfth, and sixteenth feeders, and the background structure being knitted in a color c at the other feeders that are the first, third, fifth, seventh, ninth, eleventh, thirteenth, and fifteenth feeders.

6. The method for producing a background structure in a jacquard fabric for a mattress ticking according to claim 1, further comprising:

inserting lay-in yarn between the first feeder and the second feeder, between the third feeder and the fourth feeder, between the fifth feeder and the sixth feeder, between the seventh feeder and the eighth feeder, between the ninth feeder and the tenth feeder, between the eleventh feeder and the twelfth feeder, between the thirteenth feeder and the fourteenth feeder, and between the fifteenth feeder and the sixteenth feeder.

7. The method for producing a background structure in a jacquard fabric for a mattress ticking according to claim 1, wherein the cylinder needles and the dial needles are selected in an opposite manner.

8. A jacquard fabric for a mattress ticking obtained by the method according to claim 1.

9. A jacquard fabric for a mattress ticking comprising two or more courses, wherein, in any one of the two or more courses, two loops are consecutively formed on a front surface of a rib structure, one loop is left out, thereafter, two loops are consecutively formed on a back surface, and loops are thereafter repeatedly formed in the same manner; and in another one of the two or more courses, three loops are consecutively left out and one loop is formed on the back surface, and loops are thereafter repeatedly formed in the same manner.

10. The jacquard fabric for a mattress ticking according to claim 9, wherein, in a course direction from a reference position (a reference front loop in an odd-numbered course, or a back loop opposed to and on the right of the front loop in an even-numbered course), in a first course, knitting yarn is knitted for two consecutive front loops and welted for one front loop, thereafter, on a back loop side, the knitting yarn is knitted for two consecutive back loops, and loops are thereafter repeatedly formed in the same manner;

in a second course, the knitting yarn is welted for two consecutive back loops, knitted for one back loop, welted for one back loop, and loops are thereafter repeatedly formed in the same manner;

in a third course, the knitting yarn is welted for one front loop, thereafter, on the back loop side, knitted for two consecutive back loops, thereafter, on a front loop side, knitted for two consecutive front loops, and loops are thereafter repeatedly formed in the same manner;

in a fourth course, the knitting yarn is welted for one back loop, knitted for one back loop, welted for two consecutive back loops, and loops are thereafter repeatedly formed in the same manner;

in a fifth course, the knitting yarn is knitted for one back loop, thereafter, on the front loop side, knitted for two consecutive front loops, welted for one front loop, thereafter, on the back loop side, knitted for one back loop, and loops are thereafter repeatedly formed in the same manner;

in a sixth course, the knitting yarn is welted for three consecutive back loops, knitted for one back loop, and loops are thereafter repeatedly formed in the same manner;

in a seventh course, the knitting yarn is knitted for one front loop, welted for one front loop, thereafter, on the back loop side, knitted for two consecutive back loops, thereafter, on the front loop side, knitted for one front loop, and loops are thereafter repeatedly formed in the same manner;

in an eighth course, loops are formed in the same manner as in the second course;

in a ninth course, loops are formed in the same manner as in the third course;

in a tenth course, the knitting yarn is knitted for one back loop, welted for three consecutive back loops, and loops are thereafter repeatedly formed in the same manner;

in an eleventh course, loops are formed in the same manner as in the first course;

in a twelfth course, loops are formed in the same manner as in the sixth course;

in a thirteenth course, loops are formed in the same manner as in the seventh course;

in a fourteenth course, loops are formed in the same manner as in the fourth course;

in a fifteenth course, loops are formed in the same manner as in the fifth course;

in a sixteenth course, loops are formed in the same manner as in the tenth course; and thereafter the first to sixteenth courses are repeated in a wale direction.

11. The method for producing a background structure in a jacquard fabric for a mattress ticking according to claim 2, wherein, in (ii), a twill pattern is formed by knitting at a plurality of feeders with one needle shifted from a reference position by one or more needles.

12. The method for producing a background structure in a jacquard fabric for a mattress ticking according to claim 2, further comprising:

inserting lay-in yarn between the first feeder and the second feeder, between the third feeder and the fourth feeder, between the fifth feeder and the sixth feeder, between the seventh feeder and the eighth feeder, between the ninth feeder and the tenth feeder, between the eleventh feeder and the twelfth feeder, between the thirteenth feeder and the fourteenth feeder, and between the fifteenth feeder and the sixteenth feeder.

13. The method for producing a background structure in a jacquard fabric for a mattress ticking according to claim 3, further comprising:

inserting lay-in yarn between the first feeder and the second feeder, between the third feeder and the fourth feeder, between the fifth feeder and the sixth feeder, between the seventh feeder and the eighth feeder, between the ninth feeder and the tenth feeder, between the eleventh feeder and the twelfth feeder, between the thirteenth feeder and the fourteenth feeder, and between the fifteenth feeder and the sixteenth feeder.

14. The method for producing a background structure in a jacquard fabric for a mattress ticking according to claim 4, further comprising:

inserting lay-in yarn between the first feeder and the second feeder, between the third feeder and the fourth feeder, between the fifth feeder and the sixth feeder, between the seventh feeder and the eighth feeder, between the ninth feeder and the tenth feeder, between the eleventh feeder and the twelfth feeder, between the thirteenth feeder and the fourteenth feeder, and between the fifteenth feeder and the sixteenth feeder.

15. The method for producing a background structure in a jacquard fabric for a mattress ticking according to claim 5, further comprising:

inserting lay-in yarn between the first feeder and the second feeder, between the third feeder and the fourth feeder, between the fifth feeder and the sixth feeder, between the seventh feeder and the eighth feeder, between the ninth feeder and the tenth feeder, between the eleventh feeder and the twelfth feeder, between the thirteenth feeder and the fourteenth feeder, and between the fifteenth feeder and the sixteenth feeder.

16. The method for producing a background structure in a jacquard fabric for a mattress ticking according to claim 2, wherein the cylinder needles and the dial needles are selected in an opposite manner.

17. The method for producing a background structure in a jacquard fabric for a mattress ticking according to claim 3, wherein the cylinder needles and the dial needles are selected in an opposite manner.

18. The method for producing a background structure in a jacquard fabric for a mattress ticking according to claim 4, wherein the cylinder needles and the dial needles are selected in an opposite manner.

19. The method for producing a background structure in a jacquard fabric for a mattress ticking according to claim 5, wherein the cylinder needles and the dial needles are selected in an opposite manner.

20. A jacquard fabric for a mattress ticking obtained by the method according to claim 4.

* * * * *